US005856644A

United States Patent [19]

Burgess

[11] Patent Number: 5,856,644

[45] Date of Patent: Jan. 5, 1999

[54] DRAPE SENSOR

[76] Inventor: Lester E. Burgess, Box 522, Swarthmore, Pa. 19081

[21] Appl. No.: 778,239

[22] Filed: Jan. 8, 1997

Related U.S. Application Data

[63] Continuation-in-part of Ser. No. 429,683, Apr. 27, 1995, Pat. No. 5,695,859.

[51] Int. Cl.[6] ..... H01H 3/16; H01H 3/02

[52] U.S. Cl. ..... 200/61.43; 200/61.93

[58] Field of Search ..... 200/61.42, 61.43, 200/61.93; 340/545

[56] References Cited

U.S. PATENT DOCUMENTS

| | | |
|---|---|---|
| 2,951,817 | 9/1960 | Myers . |
| 3,315,050 | 4/1967 | Miller . |
| 3,321,592 | 5/1967 | Miller . |
| 3,462,885 | 8/1969 | Miller . |
| 3,634,334 | 1/1972 | Burgess . |
| 3,668,337 | 6/1972 | Sinclair . |
| 3,693,026 | 9/1972 | Miller . |
| 3,754,176 | 8/1973 | Miller . |
| 3,855,733 | 12/1974 | Miller . |
| 3,859,485 | 1/1975 | Blinkilde et al. . |
| 3,896,590 | 7/1975 | Miller . |
| 4,014,217 | 3/1977 | Lagasse et al. . |
| 4,051,336 | 9/1977 | Miller . |
| 4,115,952 | 9/1978 | French . |
| 4,121,488 | 10/1978 | Akiyama . |
| 4,133,365 | 1/1979 | Schleicher . |
| 4,137,116 | 1/1979 | Miller . |
| 4,143,367 | 3/1979 | Schestag . |
| 4,172,216 | 10/1979 | O'Shea . |
| 4,200,777 | 4/1980 | Miller . |
| 4,273,974 | 6/1981 | Miller . |
| 4,349,710 | 9/1982 | Miller . |
| 4,369,344 | 1/1983 | Diamond . |
| 4,396,814 | 8/1983 | Miller . |
| 4,481,815 | 11/1984 | Overton . |
| 4,497,989 | 2/1985 | Miller . |
| 4,620,072 | 10/1986 | Miller . |
| 4,640,137 | 2/1987 | Trull et al. . |
| 4,661,664 | 4/1987 | Miller . |
| 4,785,143 | 11/1988 | Miller . |
| 4,801,771 | 1/1989 | Mizuguchi et al. ..... 200/86 R |
| 4,837,548 | 6/1989 | Lodini . |
| 4,845,323 | 7/1989 | Beggs . |
| 4,876,419 | 10/1989 | Lodini . |
| 4,876,420 | 10/1989 | Lodini . |
| 4,900,497 | 2/1990 | Lodini . |
| 4,908,483 | 3/1990 | Miller . |
| 4,920,241 | 4/1990 | Miller . |
| 4,951,985 | 8/1990 | Pong et al. . |
| 4,954,673 | 9/1990 | Miller . |
| 4,964,302 | 10/1990 | Grahn et al. . |
| 4,972,054 | 11/1990 | Miller et al. . |
| 4,977,386 | 12/1990 | Lodini . |
| 4,994,634 | 2/1991 | Tanji et al. ..... 200/5 A |
| 5,010,774 | 4/1991 | Kikuo et al. . |
| 5,019,797 | 5/1991 | Marstiller et al. . |

(List continued on next page.)

FOREIGN PATENT DOCUMENTS

| | | |
|---|---|---|
| 167341 | 1/1986 | European Pat. Off. . |
| 293734 | 12/1988 | European Pat. Off. . |
| 1942565 | 4/1971 | Germany . |
| 2026894 | 12/1971 | Germany . |
| 2045527 | 10/1980 | United Kingdom . |

*Primary Examiner*—Wynn Wood Coggins
*Assistant Examiner*—Michael J. Hayes
*Attorney, Agent, or Firm*—Dilworth & Barrese

[57] ABSTRACT

A freely hanging drape sensor distinguishing between weak and strong activation of the sensor includes a piezoresistive cellular material and standoff layer for providing an analog signal correlated with the strength of an activating force, as well as an on-off function. The drape sensor can be used in conjunction with moving objects, such as electrically operated doors to provide safety door edges. Alternatively, the drape sensor can be used as freely hanging curtains to detect objects moving into contact therewith.

23 Claims, 6 Drawing Sheets

U.S. PATENT DOCUMENTS

| | | |
|---|---|---|
| 5,019,950 | 5/1991 | Johnson . |
| 5,023,411 | 6/1991 | Miller et al. . |
| 5,027,552 | 7/1991 | Miller et al. . |
| 5,060,527 | 10/1991 | Burgess . |
| 5,066,835 | 11/1991 | Miller et al. . |
| 5,072,079 | 12/1991 | Miller . |
| 5,089,672 | 2/1992 | Miller . |
| 5,132,583 | 7/1992 | Chang . |
| 5,203,110 | 4/1993 | Hörmann . |
| 5,260,529 | 11/1993 | Miller . |
| 5,264,824 | 11/1993 | Hour . |
| 5,399,851 | 3/1995 | Strand . |
| 5,418,342 | 5/1995 | Miller . |
| 5,426,293 | 6/1995 | Miller et al. . |
| 5,438,798 | 8/1995 | Plamper et al. . |
| 5,477,217 | 12/1995 | Bergan . |
| 5,510,812 | 4/1996 | O'Mara et al. . |

DRAPE SENSOR

CROSS-REFERENCE TO RELATED APPLICATIONS

This is a continuation-in-part of U.S. application Ser. No. 08/429,683 filed Apr. 27, 1995, now issued as U.S. Pat. No. 5,695,859.

BACKGROUND

1. Field of the Invention

The present invention relates to a pressure actuated sensor which serves as a switching device, for example, for activating and/or shutting down of equipment or machinery.

2. Background of the Art

Pressure actuated switches are known in the art. Such switches are used for example as safety mats, sensitive door edges, and the like. Typically, such switches include two spaced apart conductors. When pressure is applied the conductors contact each other, thereby closing an electrical circuit. This switching action can be used to activate or, alternatively, deactivate machinery. For example, on mechanically operated doors, the doors commonly include a sensitive edge switch. Should the edge switch make contact with an object in its path (e.g. a person) while the door is closing the edge switch will send a signal to a control unit to reverse or stop the movement of the door. Such edge switches may commonly be found on garage doors, train doors, and the like.

For example, U.S. Pat. No. 5,072,079 to Miller discloses a sensing edge causing a closing door to open by actuating a device upon force being applied to the sensing edge. The sensing edge includes a first sheet of resiliently compressible material, a first sheet of electrically conductive material, a layer of non-conductive material, a second sheet of electrically conductive material, a second sheet of resiliently compressible material and an elongate inner core arranged in the recited order. The inner core has a predetermined elastic compressibility which is selected in accordance with the desired sensitivity of the sensing edge, such that the sensitivity of the sensing edge directly corresponds to the elastic compressibility of the inner core. The first and second sheets of flexible, electrically conductive material are spaced apart by the layer of non-conductive material and present opposed portions to each other through an opening in the layer of non-conductive material whereby upon the application of force to the sheath, the inner core compresses until its elastic compressibility is less than the elastic compressibility of said first and second layers of resiliently compressible material and said layer of non-conductive material, whereupon a portion of the first sheet of flexible, electrically conductive material deflects into the opening in the second layer of non-conductive material and into contact with a portion of the second sheet of flexible, electrically conductive material to thereby actuate the device.

Other edge switches are disclosed, for example, in U.S. Pat. Nos. 5,027,552; 5,023,411; 4,920,241; 4,908,483; 4,785,143; 4,349,710; 4,273,974; 4,051,336; and 3,315,050.

While prior known edge switches are useful for detecting the presence of an object in the path of a moving door, being fully on or completely off they do not discriminate between the signals resulting from contact of the edge switch with large objects, and spurious signals resulting from, for example, disparities in the interfacing surfaces of the switch caused by uneven extrusion.

SUMMARY

A drape sensor is provided herein which distinguishes between weak and strong activation of the sensor by providing an analog signal correlated with the strength of an activating force, as well as an on-off function. The sensor can be used in conjunction with moving objects, such as electrically operated doors. Alternatively the drape sensor can be used as freely hanging curtains to detect objects moving into contact therewith.

The drape sensor is a pressure actuated switching device which includes first and second conductive layers, a layer of compressible piezoresistive material for making electrical contact between the first and second conductive layers, and at least one insulative spacer means for spacing apart the piezoresistive material and said second conductive layer, the spacer means having open spaces to permit passage therethrough of at least a portion of the piezoresistive material, wherein in response to a predetermined amount of force applied thereto the piezoresistive material disposes itself through at least some of the open spaces to make electrical contact with the second conductive layer.

Also provided herein is a method for sensing the movement of objects through a passageway including the steps of providing a drape sensor positioning the sensor within a passageway, and conducting signals generated by the sensor to an analyzer.

DETAILED DESCRIPTION OF PREFERRED EMBODIMENTS

The terms "insulating", "conducting", "resistance", and their related forms are used herein to refer to the electrical properties of the materials described, unless otherwise indicated. The terms "top", "bottom", "above", and "below", are used relative to each other. The terms "elastomer" and "elastomeric" are used herein to refer to material that can undergo at least 10% deformation elastically. Typically, "elastomeric" materials suitable for the purposes described herein include polymeric materials such as natural and synthetic rubbers and the like. As used herein the term "piezoresistive" refers to a material having an electrical resistance which decreases in response to compression caused by mechanical pressure applied thereto in the direction of the current path. Such piezoresistive materials typically are resilient cellular polymer foams with conductive coatings covering the walls of the cells. "Resistance" refers to the opposition of the material to the flow of electric current along the current path in the material and is measured in ohms. Resistance increases proportionately with the length of the current path and the specific resistance, or "resistivity" of the material, and it varies inversely to the amount of cross sectional area available to the current. The resistivity is a property of the material and may be thought of as a measure of (resistance/length)/area. More particularly, the resistance may be determined in accordance with the following formula:

$$R=(\rho L)/A \quad \text{(I)}$$

where

R=resistance in ohms

ρ=resistivity in ohms-inches

L=length in inches

A=area in square inches

The current through a circuit varies in proportion to the applied voltage and inversely with the resistance, as provided in Ohm's Law:

$$I=V/R \quad \text{(II)}$$

where

I=current in amperes

V=voltage in volts

R=resistance in ohms

Typically, the resistance of a flat conductive sheet across the plane of the sheet, i.e., from one edge to the opposite edge, is measured in units of ohms per square. For any given thickness of conductive sheet, the resistance value across the square remains the same no matter what the size of the square is. In applications where the current path is from one surface to another of the conductive sheet, i.e. in a direction perpendicular to the plane of the sheet, resistance is measured in ohms.

Figure 1:
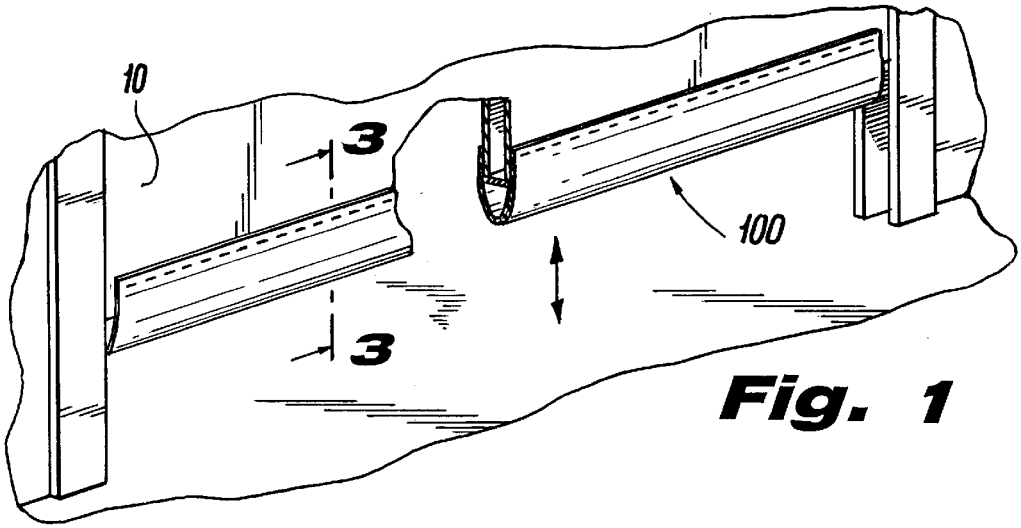
FIG. 1 is a perspective view illustrating the drape sensor in conjunction with a door.

Referring now to FIG. 1 a door 10 is shown with drape sensor 100 attached to the bottom edge thereof. The door is preferably of the type which opens and closes in ascending/descending motion, such as for example, garage doors, roll doors for industrial buildings and the like. The sensor described herein is particularly useful on high speed doors which move at speeds of up to 100 inches per second.

As can be seen from FIG. 1, drape sensor 100 is fastened to the bottom edge of the door 10. In the event that drape sensor 100 contacts an object in the path of the closing door, a signal is sent to the door controller to stop or reverse the door. Drape sensor 100 is attached to the door edge and comprises several layers. A sensor suitable for use in the present invention is disclosed and described in U.S. application Ser. No. 08/429,683 filed Apr. 27, 1995, Pat. No. 5,693,859 which is herein incorporated by reference and directed to a pressure actuated switching device. It is altogether surprising that such pressure actuated switching devices using piezoresistive materials in conjunction with a standoff can be used as drapes, i.e. supported only at one or two edges, with substantially no support along the surface such as a mat switch would have when placed on the floor. Therefore, a significant feature of the drape sensor 100 is that it is not stiff. It drapes freely and flaccidly from the door edge as would a fabric.

Figure 2:
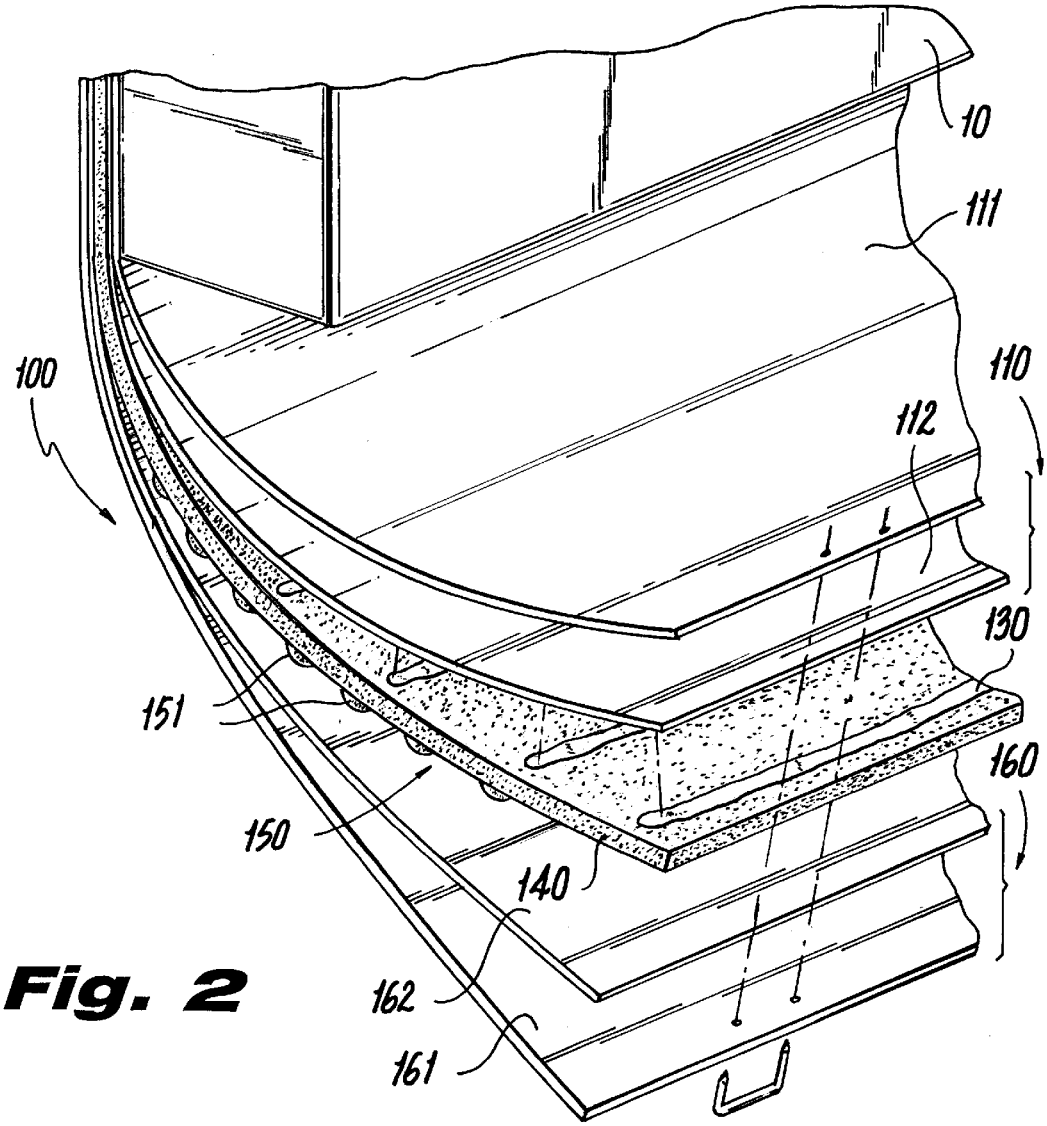
FIG. 2 is an exploded perspective view of the drape sensor of FIG. 1.
Figure 3:
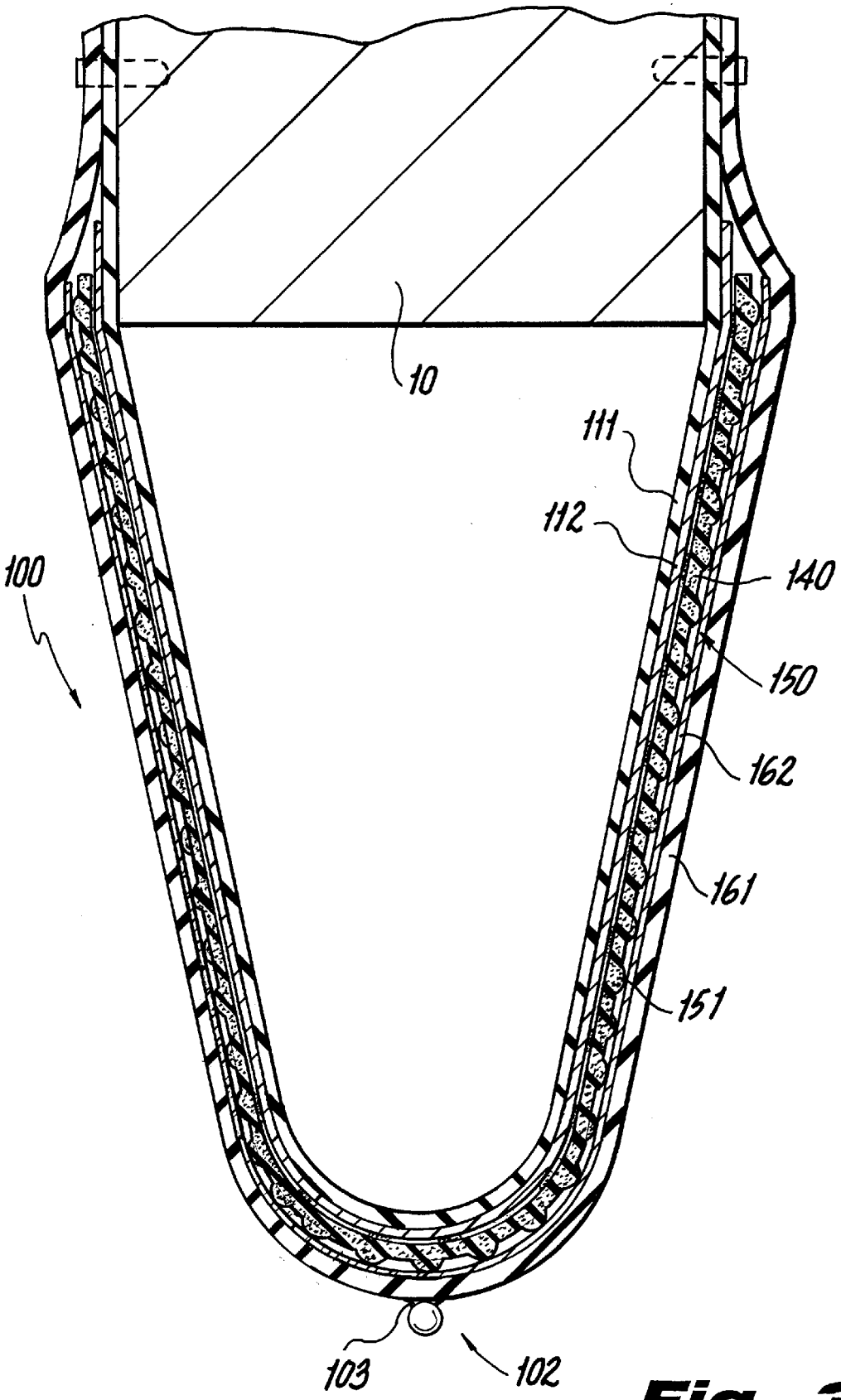
FIG. 3 is a side sectional view of the drape sensor.

Referring now to FIGS. 2 and 3, drape sensor 100 includes a first cover sheet 110 having a first non-conductive cover layer 111 and a conductive film 112 bonded thereto. The conductive film 112 is attached to piezoresistive foam layer 140 by means of adhesive strips 130. The piezoresistive foam 140 is separated from second conductive film 162 by means of a standoff 150. Conductive film 162 is bonded to the second non-conductive cover layer 161 to form an outside second cover sheet 160. The first and second conductive films 112 and 162, respectively, are connected to electrical lead wires (not shown) and switching of drape sensor 100 is accomplished by the formation of a conductive path between the first and second conductive films.

More particularly, the non-conducting layer 111 of cover sheet 110 is preferably elastomeric, but it can alternatively be flexible without being elastomeric. Preferably, the non-conducting layer 111 is fabricated from rubber or plasticized polyvinyl chloride (PVC) sheet to which is bonded the conductive layer 112. The conductive layer 112 is also preferably elastomeric and can be fabricated from conductive fibers and powders as described below with respect to the piezoresistive foam layer 140 except that the polymer matrix for conductive layer 112 need not be cellular. Preferably a plasticized PVC resin is used as the matrix for the conductive layer 112 as set forth in Example 1. Alternatively, a silicone elastomer can be used instead of plasticized PVC. The elastomeric conductive layer 112 can also be applied by spray coating the non-conductive layer. Preferably, a portion of the non-conductive layer 111 is left uncoated in the vicinity of its periphery to facilitate the hermetic sealing of first non-conductive layer 111 with second non-conductive layer 161.

EXAMPLE 1

A conductive filler was made from 60 grams of graphite pigment (Asbury Graphite A60), 0.4 grams carbon black (Shawingigan Black A). This filler was dispersed into 108.0 grams of plasticized PVC resin. A solvent was added to facilitate spraying.

The result of a spray applied film was a surface having a sheet resistance of about 100–1,000 ohms/square.

Alternatively, the cover sheet 110 can comprise a sheet of metallized polymer such as aluminized MYLAR® brand polymer film, the coating of aluminum providing the conductive layer 112.

Preferably, the upper layer 111 is a plasticized PVC sheeting or fabric impregnated with plasticized PVC which is heat sealed or otherwise bonded (for example, by solvent welding) to a PVC second cover layer 161 at the uncoated edges to cause a hermetic seal. Subsequent cast molding of the end edges by using a mold and PVC plastisol provides improved quality to the hermetic seal while offering a good cosmetic appearance. Plastisol is a high molecular weight dispersion of PVC in plasticizer.

The first conductive layer 112 is bonded to the piezoresistive foam layer 140 by means of adhesive strips 130. The strips are spaced apart from each other, the spaces permitting electrical contact between the conductive elastomeric film 112 and the piezoresistive foam 140. The adhesive is preferably a room temperature vulcanizing silicone resin. Such adhesive resins are widely available. Alternatively, other types of adhesives may be used.

The piezoresistive layer 140 is a conductive polymeric foam which comprises a flexible and resilient sheet of cellular polymeric material having a resistance which changes in relation to the magnitude of pressure applied to it. Typically, the piezoresistive foam layer 140 may range from 1/32" to about 1/2", although other thicknesses may also be used when appropriate. A conductive polymeric foam suitable for use in the present apparatus is disclosed in U.S.

Pat. No. 5,060,527. Other conductive foams are disclosed in U.S. Pat. No. 4,951,985 and 4,172,216.

Generally, such conductive foams are open cell foams. Open cell foams have a 3-dimensional network or lattice structure of matrix material with open interstices. The foam is made conductive by, for example, dipping the foam into a resin slurry of conductive filler to incorporate the filler into the interstices and coat the matrix framework. When such foam is cut to generate a leading surface, the matrix framework at the surface comprises elongated fiber-like extensions. Upon activation of the sensor these fiber like extensions on the leading surface of the piezoresistive foam extend through the standoff opening to make first contact with the second electrode, i.e. the second conductive layer 112. This contact is initially at high resistance. However, upon further compression of the piezoresistive foam the resistance decreases, thereby increasing current flow. When a force is applied the piezoresistive foam is compressed and the overall resistance is lowered because the resistivity as well as the current path are reduced. For example, an uncompressed piezoresistive foam may have a resistance of 100,000 ohms, whereas when maximally compressed to its smallest thickness the resistance may drop to 300 ohms.

An alternative conductive piezoresistive polymer foam suitable for use in the present invention is an intrinsically conductive expanded polymer (ICEP) cellular foam comprising an expanded polymer with premixed filler comprising conductive finely divided (preferably colloidal) particles and conductive fibers. See, e.g. U.S. application Ser. No. 08/429,683, mentioned above. Typically, conductive cellular foams comprise a nonconductive expanded foam with a conductive coating dispersed through the cells. Such foams are limited to open celled foams to permit the interior cells of the foam to receive the conductive coating.

An intrinsically conductive expanded foam differs from the prior known expanded foams in that the foam matrix is itself conductive. The difficulty in fabricating an intrinsically conductive expanded foam is that the conductive filler particles, which have been premixed into the unexpanded foam, spread apart from each other and lose contact with each other as the foam expands, thereby creating an open circuit.

Surprisingly, the combination of conductive finely divided particles with conductive fibers allows the conductive filler to be premixed into the resin prior to expansion without loss of conductive ability when the resin is subsequently expanded. The conductive filler can comprise an effective amount of conductive powder combined with an effective amount of conductive fiber. By "effective amount" is meant an amount sufficient to maintain electrical conductance after expansion of the foam matrix. The conductive powder can be powdered metals such as copper, silver, nickel, goal, and the like, or powdered carbon such as carbon black and powdered graphite. The particle size of the conductive powder typically ranges from diameters of about 0.01 to about 25 microns, the particles being irregularly shaped, but having a generally round configuration. The conductive fibers can be metal fibers or, preferably, graphite, and typically range from about 0.01 to about 0.5 inches in length. Typically, the amount of conductive powder ranges from about 15% to about 80% by weight of the total composition. The conductive fibers typically range from about 0.1% to about 10% by weight of the total composition.

The intrinsically conductive foam can be made according to the procedure described in Example 2 below. With respect to Example 2, the silicone resin is obtainable from the Dow Corning Company under the designation SILASTIC™ S5370 silicone resin. The graphite pigment is available as asbury graphite A60. The carbon black pigment is available as shawingigan black carbon. The graphite fibers are obtainable as Hercules Magnamite Type A graphite fibers. A significant advantage of intrinsically conductive foam is that it can be a closed cell foam.

EXAMPLE 2

108 grams of silicone resin were mixed with a filler comprising 40 grams of graphite pigment, 0.4 grams of carbon black pigment, 3.0 grams of ¼" graphite fibers. After the filler was dispersed in the resin, 6.0 grams of foaming catalyst was stirred into the mixture. The mixture was case in a mold and allowed to foam and gel to form a piezoresistive elastomeric polymeric foam having a sheet resistance of about 50K ohms/square.

The preformed silicone resin can be thinned with solvent, such as methylethyl ketone to reduce the viscosity. The polymer generally forms a "skin" when foamed and gelled. The skin decreases the sensitivity of the piezoresistive sheet because the skin generally has a high resistance value which is less affected by compression. Optionally, a cloth can be lined around the mold into which the prefoamed resin is cast. After the resin has been foamed and gelled, the cloth can be pulled away from the polymer, thereby removing the skin and exposing the polymer cells for greater sensitivity.

When loaded, i.e. when a mechanical force or pressure is applied thereto, the resistance of a piezoresistive foam drops in a manner which is reproducible. That is, the same load repeatedly applied consistently gives the same values of resistance. Also, it is preferred that the cellular foam displays little or no resistance hysteresis. That is, the measured resistance of the conductive foam for a particular amount of compressive displacement is substantially the same whether the resistance is measured when the foam is being compressed or expanded.

Advantageously, the piezoresistive foam layer 140 accomplishes sparkless switching of the apparatus, which provides a greater margin of safety in environments with flammable gases or vapors present.

The standoff layer 150 functions as a means for spacing the piezoresistive layer 140 apart from the conductive layer 162 so as to maintain an open circuit condition when the drape sensor 100 is not activated. The standoff layer 150 thereby provides an on-off function. The standoff layer 150 can alternatively be relatively rigid or compressible.

In one embodiment standoff 150 comprises a plurality of electrically insulative dots 151 which are unconnected and laterally spaced apart from each other. The dots can be, for example, hemispherical in shape and composed of either foamed polymer resin or non-cellular polymer. For example, the dots can be made from plasticized PVC and applied to the piezoresistive layer 140 through a patterned screen after layer 140 has been fabricated, and then allowing the dots to harden or cure. Other materials for making the dots can include acrylic polymers, polyolefins, or polycarbonate dissolved in a solvent and applied as a viscous liquid which is then allowed to harden by evaporation. Alternatively, the dots can be a prepolymer which is later cured by a curing agent, e.g. ultraviolet light. In yet another alternative the dots can be a foamable insulative resin applied to the surface of the piezoresistive material prior to foaming, and then foamed with the piezoresistive layer 140. By way of example the dots are preferably about 1/32inch to about ¼inch in height, and spaced apart about 1/16inch to ½inch.

Figure 4:
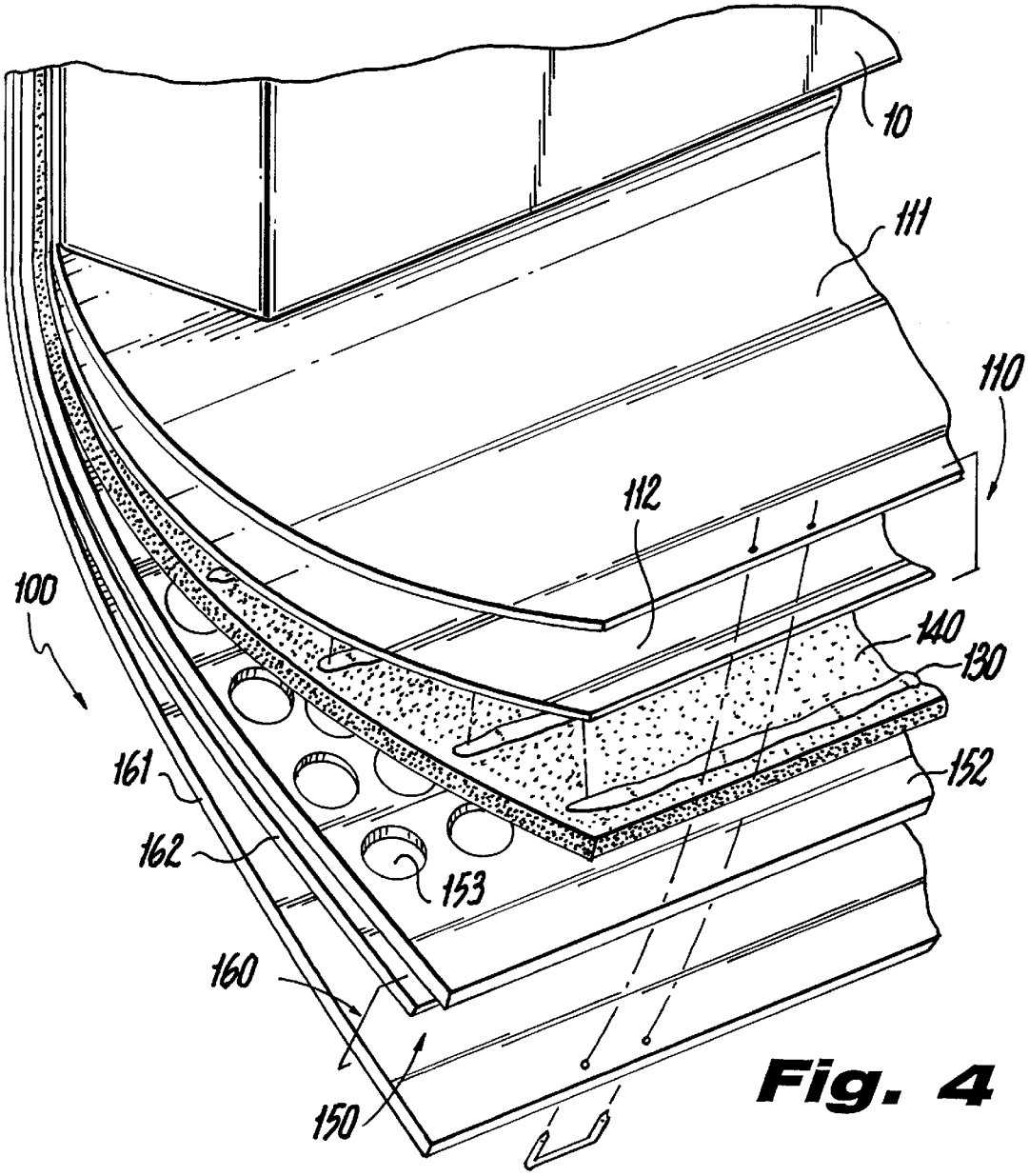
FIG. 4 is an exploded perspective view of an alternative embodiment of the drape sensor.

Referring now to FIG. 4, in yet another embodiment the standoff layer comprises a sheet 152 of electrically insulative material having a plurality of openings 153 for permitting the piezoresistive material to dispose itself therethrough, whereupon the conductive fiber-like extensions of the foam's leading surface contact the second conductive layer 162, and with further compression become a significant conductive link between the two layers. For example, the standoff 150 can be a sheet of neoprene having a plurality of spaced apart circular (or other shaped) openings 153. The sheet 152 can range in thickness from about 1/32inch to about 1/4inch. The openings 153 can range in diameter from about 1/16inch to about 1.0 inch. These dimensions are given for purposes of exemplification. Other smaller or larger dimensions suitable for the desired application can alternatively be chosen.

The size and configuration of the standoff 150 can be designed to achieve predetermined threshold values of force below which the drape sensor 100 will not be actuated. This characteristic also controls the force relationship to the analog output as the piezoresistive material or configuration is compressed. Upon application of a predetermined sufficient amount of force the conductive piezoresistive material 140 presses through the standoff holes 153 to make electrical contact with conductive layer 162 below. The predetermined minimum amount of force sufficient to actuate the switch depends at least in part on the hole diameter, the thickness of the standoff 150, and the degree of rigidity of the standoff (a highly rigid standoff requires greater activation force than a low rigidity, i.e., compressible, standoff).

The second conductive layer 162 is preferably elastomeric and fabricated in the same manner as conductive layer 112. Alternatively conductive layer 162 can be a metallized polymer sheet. Second conductive layer 162 is bonded to non-conductive cover layer 161 to form outside cover sheet 160. The non-conductive cover layer 161 is preferably fabricated in the same manner as first cover layer 111, from similar material, such as rubber or plasticized PVC. The cover layers 111 and 161 may be bonded together around their edges by stitching, stapling, and/or adhesive sealing to form a hermetically sealed edge. The drape sensor may be attached to door 10 by fasteners, adhesive, or any other suitable method.

It should be noted that no bonding is necessary between the standoff and the second conductive layer, nor is bonding required between the piezoresistive foam sheet 140 and standoff perforated sheet 152. It is altogether surprising that these layers are able to shift laterally relative to each other and still provide reproducible switching and analog function.

The pressure actuated drape sensor 100 can be assembled by providing a draped frame with a cylindrical base having about the same diameter as the width of the door to which the sensor 100 is to be attached, and with about the same length. The cover sheet 110 is first draped over the frame, with the conductive layer 112 on top, followed by application of adhesive strips 130, then the piezoresistive foam sheet 140. During the fabrication process connections between the conductive layers 112 and 162 and electrical leads can be made. Standoff 150 is then draped over, if it is embodied as a perforated sheet. If the standoff 150 is a layer of dots 151 these dots will already be attached to the piezoresistive foam sheet and the sheet 140 will be draped over the cover sheet 110 with the dots 151 on top. The second cover layer 160 is draped over the standoff layer 150 with the conductive layer 162 facing the standoff 150. Finally, the edges of drape sensor 100 are sewn and sealed. Drape sensor 100 can then be reversed and attached to a door edge such that it drapes down as shown in FIG. 3.

Also, as shown in FIG. 3, an elongated rod 102 can be attached to the bottom of drape sensor 100 by, for example, adhesive 103 or other suitable means such that rod 102 extends along the length of the drape sensor 100. Rod 102 can be cylindrical with a circular cross section (as shown), rectangular, or of some other suitable shape. Rod 102 serves as a stiffener and facilitates the return of the sensor 100 to its initial configuration after an activation force applied to the drape sensor 100 has been terminated. The stiffening rod 102 can be fabricated from polyethylene, PVC, polycarbonate, or equivalent material, and can be, for example, about 1/4" in diameter.

Figure 5:
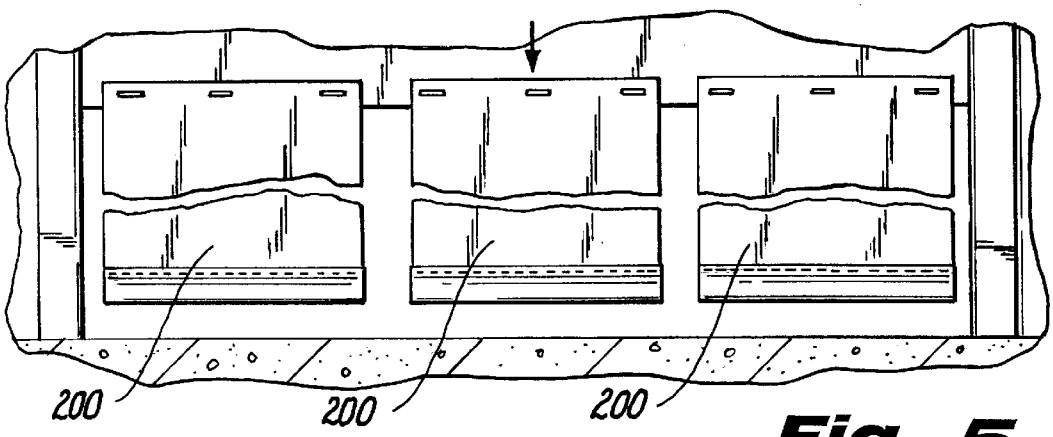
FIG. 5 is an elevational view of yet another embodiment of the drape sensor used as a sensitive curtain in a passageway.

Referring to FIG. 5, an alternative embodiment 200 of a drape sensor is shown.

Drape sensor 200 is adapted to hang down from, for example, a doorway, as a security curtain sensor or monitoring device. Drape sensor 200 can preferably be in the form of vertical strips, and serves to signal entry or exit of a person from a designated area or room. For example, for safety or security purposes it may be advantageous to activate or deactivate machinery when a person is in the vicinity. The safety drape 200 can be fabricated from materials similar to those used in drape sensor 100.

Figure 6:
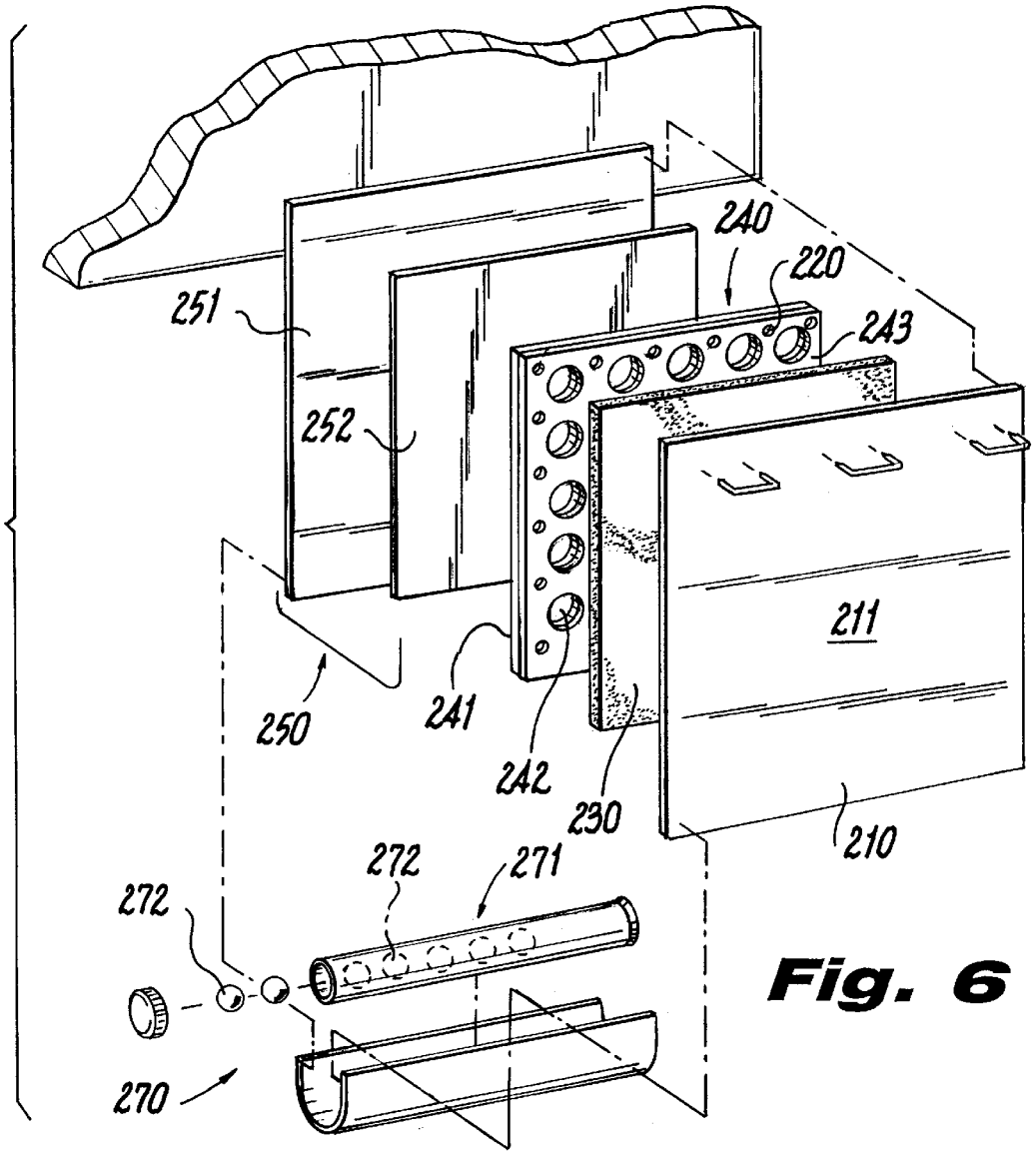
FIG. 6 is an exploded perspective view of the drape sensor of FIG. 5.
Figure 7:
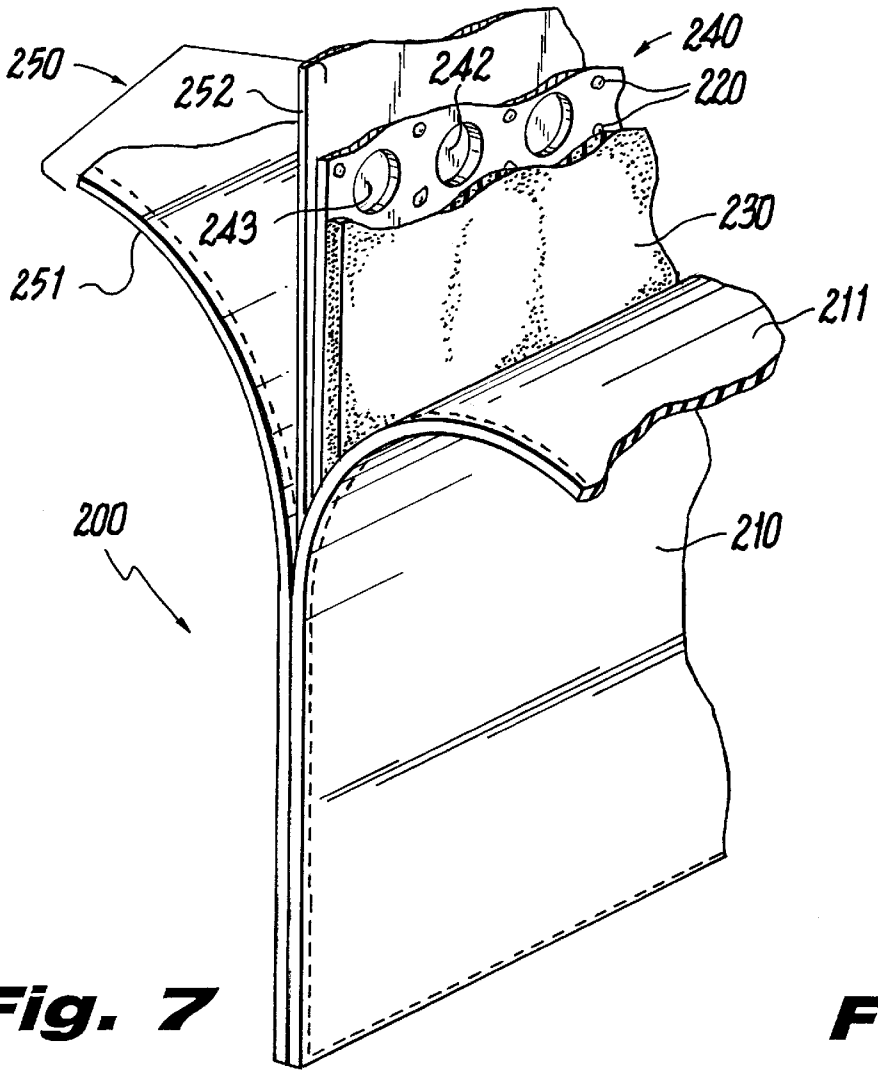
FIG. 7 is a cut away view illustrating the layers of the drape sensor of FIG. 5.

Referring to FIGS. 6 and 7, drape sensor 200 includes a first cover sheet 210 which is preferably elastomeric. Unlike cover sheet 110 of the previously described embodiment 100 of the sensor, first cover sheet 210 comprises a single layer of non-conductive material 211 and does not have a conductive layer (such as layer 112) bonded thereto. Preferred materials are natural or synthetic rubber, or plasticized PVC sheet.

The piezoresistive foam layer 230 is fabricated in a manner as described above with respect to piezoresistive layer 140.

Sheet 240 is a standoff preferably comprising a layer 241 of perforated non-conductive elastomeric material such as rubber or plasticized PVC sheet containing a plurality of openings 242. The layer 241 can range in thickness from about 1/32inch to about 1/4inch, for example. The openings 242 can range in diameter from about 1/16inch to about 1.0 inch. These dimensions are given for the purpose of exemplification.

Figure 8:
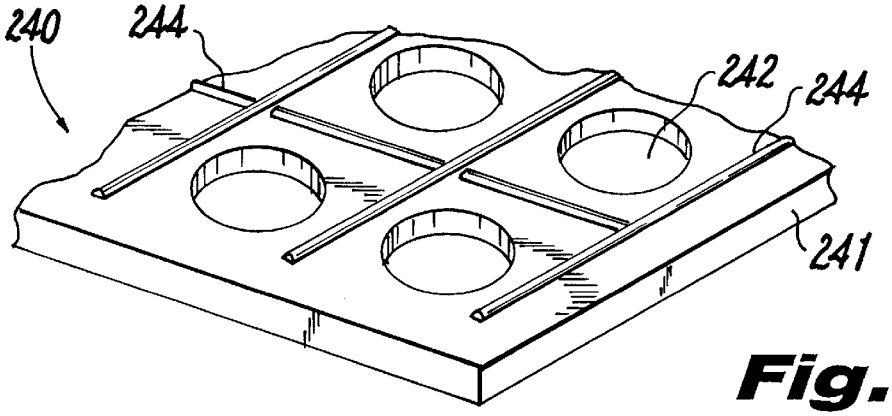
FIG. 8 is a perspective view of an alternative embodiment of the standoff with patterned electrodes.

The surface of non-conductive layer 241 facing the piezoresistive foam 230 has a conductive layer 243 thereon. The conductive layer 243 can be a film, or coating, and may be formed by any suitable method such as,for example, spraying or vacuum deposition of metal to form the coating. Conductive layer 243 is preferably a conductive elastomeric film comprising conductive filler particles dispersed in an elastomer matrix such as described above but can also be a metal film. Alternatively, as shown in FIG. 8, layer 243 can be a pattern of electrodes, for example conductive lines 244 running in transverse axes to provide positional intelligence for determining the location of an activated portion of the drape sensor 200. Adhesive dots 220 connect the piezoresistive foam layer 230 to conductive layer 423 of the standoff 240. The adhesive dots are preferably a room temperature vulcanizing silicone resin.

Second cover sheet 250 includes a non-conductive layer 251 and a conductive layer 252 bonded thereto. Layers 251 and 252 are both preferably elastomeric. For example, non-conductive layer 251 is preferably fabricated from rubber or plasticized PVC. Conductive layer 252 is preferably an elastomeric film comprising conductive filler particles dispersed in an elastomer matrix such as described above and can be fabricated as a coating on non-conductive layer 251. Alternatively conductive layer 252 can be a metallized plastic sheet such as aluminized MYLAR®.

Figure 9:
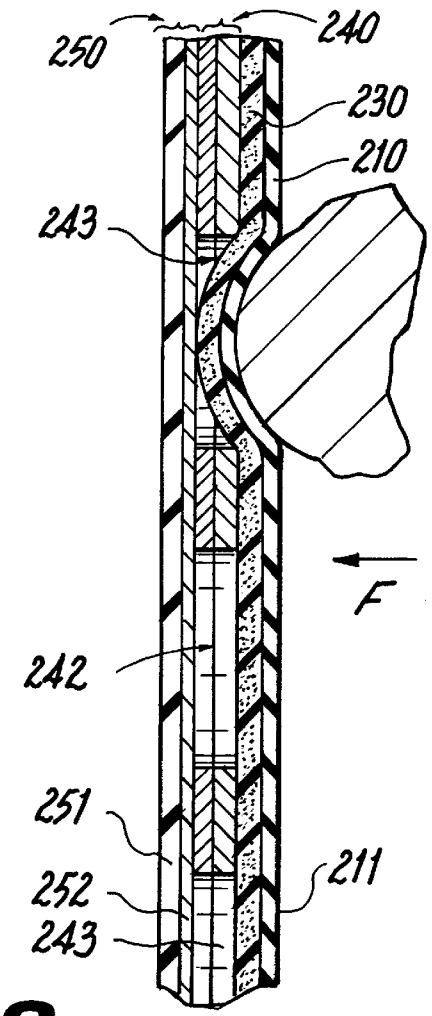
FIG. 9 is a side sectional view illustrating actuation of the drape sensor of FIG. 5.

Referring to FIG. 9, the piezoresistive foam 230 is always in contact with the first conductive layer 243, but is spaced apart from second conductive layer 252 when the sensor 200 is in an unactivated condition so as to maintain an open circuit. Upon the application of a compressive force F to the surface of the sensor 200, the piezoresistive foam 230 disposes itself through one or more openings 242 to make contact with the second conductive layer 252 thereby closing the circuit and activating the sensor for generation of a signal. Thus, in contrast to the sensor 100, both first and second conductive layers 243 and 252 are positioned on the same side of the piezoresistive layer 230, the first conductive layer 243 being between the piezoresistive foam 230 and the insulative layer 241 of the standoff, and layer 241 of the standoff being positioned between first and second conductive layers 243 and 252. As with the above described embodiment 100, sensor 200 not only provides indication of the presence or absence of a compressive actuation force, but also provides analog intelligence as to the magnitude of the force.

The cover layers 211 and 251 are preferably bonded around their edges by stitching, stapling, and/or adhesive bonding to form a hermetically sealed periphery. A weight is preferably attached to the bottom edge of the sensor strip to stabilize the sensor 200 and maintain it in a substantially vertical configuration. Weight 270 can comprise, for example, a tube 271 containing spherical weights 272.

To employ sensor 200 as a curtain sensor a plurality of sensor strips is preferably hanged side by side, optionally in an overlapping relationship in a passageway. The electrical leads from the strips are electrically connected to measuring circuitry which may optionally be connected to a computer to analyze the data received from the sensor 200. The sensor can be used to sense the movement of bodies through the passageway. For example, the sensor curtain can be used to detect and count persons, animals, vehicles, etc., and can provide information regarding the size, shape, and force or speed of passage therethrough. It should be noted that sensor 200 may alternatively be employed as a door edge sensor and sensor 100 may be employed as a component of a sensor curtain.

Figure 10:
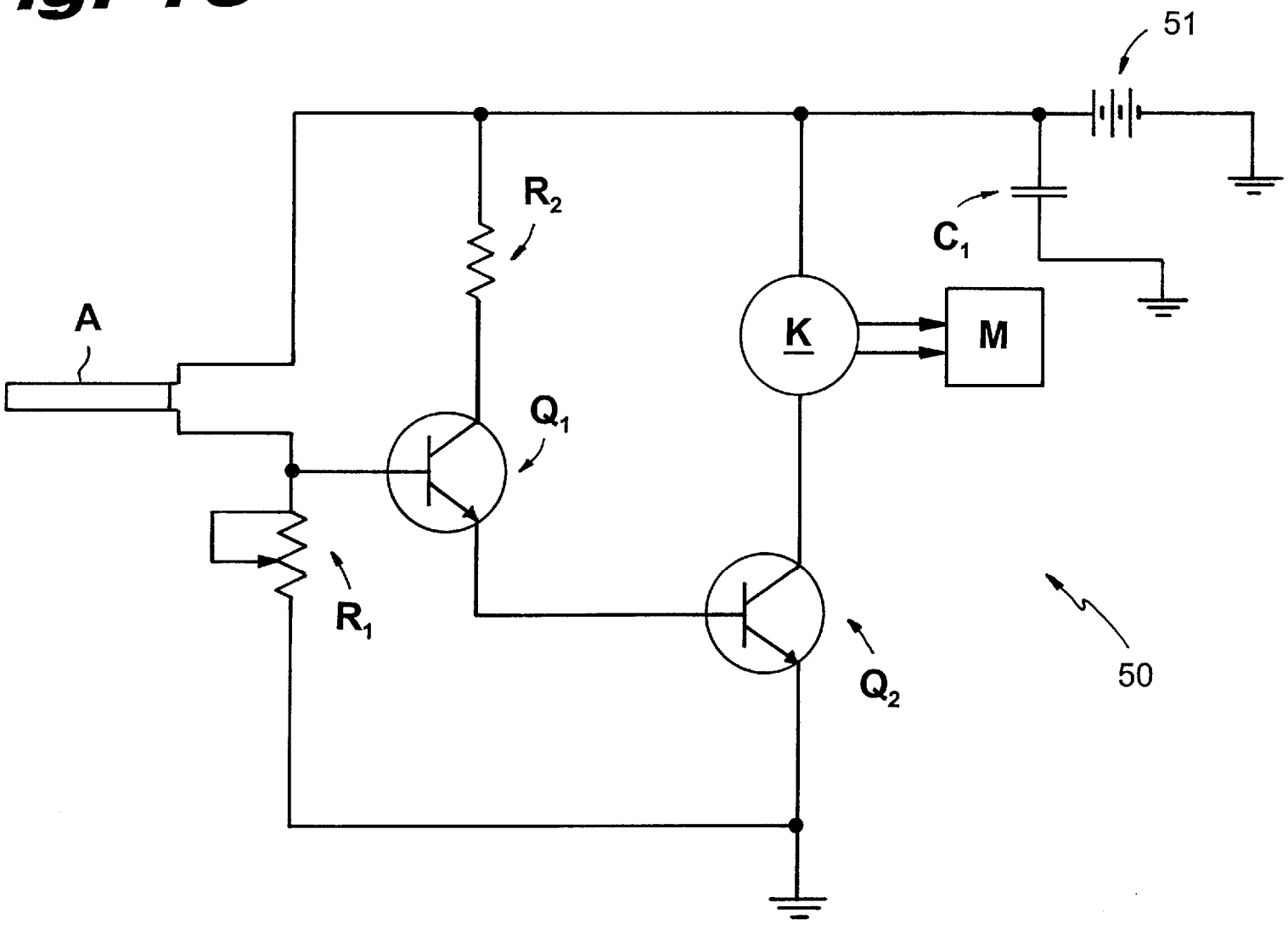
FIG. 10 is a diagram for an electrical circuit for use in conjunction with the drape sensors.

Referring now to FIG. 10, a circuit 50 is shown which can be used in conjunction with sensors 100 or 200. Circuit 50 is powered by a direct current source, e.g. battery 51, which provides a d.c. voltage $V_o$ ranging from about 12 to 48 volts. The sensor A can be any of the embodiments 100 or 200 of the invention described above.

Potentiometer $R_1$ can range from 1,000 ohms to about 10,000 ohms and provides calibration resistance. Resistor $R_2$ has a fixed resistance of from about 1,000 ohms to about 10,000 ohms. Transistors $Q_1$ and $Q_2$ provide amplification of the signal from the sensor A in order to operate relay K. Relay K can be used to open or close the electrical circuit on which the machinery M to be controlled operates. Capacitor $C_1$ ranges from between about 0.01 microfarads to about 0.1 microfarad and is provided to suppress noise. K can be replaced with a metering device to measure the force at A. This would require adjusting the ratio of $R_1$ and A (compression vs. force) to bias transistors $Q_1$ and $Q_2$ into their linear amplifying range. This circuit represents an example of how the sensors may be operated in conjunction with an electrical circuit. Many other circuits, including the use of triacs, may be employed. The plurality of strips of the sensor curtain can each be connected to a separate electrical circuit. Activation of the curtain would then provide information as to the size, shape, and impact force of the body passing through the curtain. This information can be used in preprogrammed guidance control, or other control or response means.

It will be understood that various modifications can be made to the embodiments described herein. Therefore, the above description should not be construed as limiting, but merely as exemplification of the preferred embodiments. Those skilled in the art will envision other modifications within the scope and spirit of the claims appended hereto.

What is claimed is:

1. In combination:

a) a door having an edge; and b) attached to the door edge and depending therefrom, a freely and flaccidly hanging pressure actuated switching device which includes first and second conductive layers, a layer of compressible and conductive piezoresistive material for making electrical contact between first and second conductive layers, and at least one insulative spacer means for spacing apart said piezoresistive material and said second conductive layer, said spacer means having open spaces to permit passage therethrough of at least a portion of the piezoresistive material, wherein in response to a predetermined amount of force applied thereto at least some of said piezoresistive material disposes itself through at least some of said open spaces to make electrical contact with said second conductive layer.

2. The combination of claim 1 wherein the edge of the door is the bottom edge, and the door is vertically movable between upper and lower positions.

3. The combination of claim 1 wherein the pressure actuated switching device includes first and second insulative cover layers.

4. The combination of claim 3 wherein the insulative cover layers are elastomeric.

5. The combination of claim 4 wherein the first and second conductive layers are bonded respectively to the first and second insulative cover layers.

6. The combination of claim 5 wherein the first and second conductive layers each comprise a matrix of elastomeric material with a filler of conductive particles.

7. The combination of claim 1 wherein said spacer means comprises a plurality of spaced apart dots.

8. The combination of claim 7 wherein the dots comprise foamed cellular polymeric resin.

9. The combination of claim 1 wherein said spacer means comprises a layer of insulative material having a plurality of openings.

10. The combination of claim 1 wherein said piezoresistive material is an expanded closed cell foamed material having a plurality of voids dispersed in a polymeric matrix, the matrix having a plurality of conductive particles and conductive fibers, said voids being unoccupied by the conductive particles or conductive fibers.

11. The combination of claim 1 wherein the piezoresistive material is an open cell foam with a leading surface having a plurality of elongated extensions of matrix material, the elongated extensions moving into electrical contact with the second conductive layer in response to actuation of the pressure actuated switching device.

12. The combination of claim 1 wherein the piezoresistive material is positioned between the first conductive layer and the spacer means.

13. The combination of claim 1 wherein the first conductive layer is positioned between the piezoresistive material and the spacer means, and the spacer means is positioned between the first and second conductive layers.

14. The combination of claim 1 further includes a stiffening means attached to a bottom surface of the pressure actuated switching device.

15. A method for sensing the movement of bodies through a passageway, comprising:

a) providing at least one sensor, said sensor including, first and second conductive layers, a layer of compressible piezoresistive material for making electrical contact between the first and second conductive layers, and at least one insulative spacer means for spacing apart said piezoresistive material and said second conductive layer, said spacer means having open spaces to permit passage therethrough of at least a portion of the piezoresistive material, wherein in response to a predetermined amount of actuation force applied thereto said piezoresistive material disposes itself through at least some of said open spaces to make electrical contact with said second conductive layer, and wherein each sensor is connected to an electric power source such that a signal is generated when said piezoresistive material makes contact with said second conductive layer, said signal indicating the magnitude of the actuation force;

b) positioning said at least one sensor within said passageway such that said sensor freely and flaccidly hangs from a support;

c) conducting said signal to analyzer means.

16. The method of claim 15 wherein the sensor includes first and second insulative cover layers.

17. The method of claim 15 wherein the insulative cover layers are elastomeric.

18. The method of claim 15 wherein said spacer means comprises a layer of insulative material having a plurality of openings.

19. The method of claim 15 wherein the piezoresistive material is positioned between the first conductive layer and the spacer means.

20. The method of claim 15 wherein the first conductive layer is positioned between the piezoresistive material and the spacer means, and the spacer means is positioned between the first and second conductive layers.

21. The method of claim 15 wherein at least one of said first and second conductive layers comprises a pattern of transversely oriented conductive lines.

22. The combination of claim 1 wherein said at least one insulative spacer means comprises a sheet of electrically insulative material having a plurality of openings each with a diameter ranging from about 1/16 inch to about 1 inch and having a thickness of from about 1/32 inch to about 1/4 inch.

23. The method of claim 15 wherein the at least one insulative spacer means comprises a sheet of electrically insulative material having a thickness of from about 1/32 inch to about 1/4 inch and having a plurality of openings each having a diameter of from about 1/16 inch to about 1 inch.

* * * * *